US006305058B1

(12) United States Patent
Fehrer

(10) Patent No.: US 6,305,058 B1
(45) Date of Patent: Oct. 23, 2001

(54) FACILITY FOR NEEDLING OF A PATTENED WIDTH OF FELT

(76) Inventor: Monika Fehrer, Wegscheider Strasse 15, A-4060 Leonding (AT)

( * ) Notice: Subject to any disclaimer, the term of this patent is extended or adjusted under 35 U.S.C. 154(b) by 0 days.

(21) Appl. No.: 09/656,888

(22) Filed: Sep. 7, 2000

(30) Foreign Application Priority Data

Sep. 21, 1999 (AT) ..... 1608/99

(51) Int. Cl.[7] ..... D04H 18/00
(52) U.S. Cl. ..... 28/107; 28/111
(58) Field of Search ..... 28/115, 111, 113, 28/107, 108, 109, 110, 112, 114; 112/80.4, 80.43, 80.45

(56) References Cited

U.S. PATENT DOCUMENTS

| | | | | |
|---|---|---|---|---|
| 1,745,739 | * | 2/1930 | Chase | 28/113 |
| 2,142,728 | * | 1/1939 | Kienzle . | |
| 3,368,256 | * | 2/1968 | Fehrer et al. | 28/107 |
| 3,909,891 | * | 10/1975 | Dilo | 28/111 |
| 4,038,728 | * | 8/1977 | Fehrer | 28/111 |
| 4,047,269 | * | 9/1977 | Lochner | 28/111 |
| 4,384,393 | * | 5/1983 | Asselin | 28/107 |
| 5,873,152 | * | 2/1999 | Jourde et al. | 28/107 |
| 5,909,883 | | 6/1999 | Jourde et al. . | |
| 6,161,269 | * | 12/2000 | Dilo et al. | 28/107 |

FOREIGN PATENT DOCUMENTS

| | | |
|---|---|---|
| 347 704 | 5/1978 | (AT) . |
| 2 263 949 | 7/1974 | (DE) . |

* cited by examiner

*Primary Examiner*—Amy B. Vanatta
(74) *Attorney, Agent, or Firm*—Collard & Roe, PC.

(57) ABSTRACT

The description refers to a facility for needling of a patterned width of felt (1) by means of a needling equipment comprising at least one needle board (6, 7) and a felt guide between a felt bed (9) and a stripper (11), with the felt bed (9) consisting either of lamellas (10) running in felt feed direction (3) or of a circulating brush-type bed moving along with the width of felt (1) in felt feed direction (3). To create favorable construction features, it is suggested that the needling equipment is provided with at least two independently driven needle boards (6, 7) arranged in tandem at a distance in felt feed direction (3), with needle distributions for preferably different patterns, and that the two needle boards (6, 7) are assigned to one common continuous felt bed (9) between them.

3 Claims, 1 Drawing Sheet

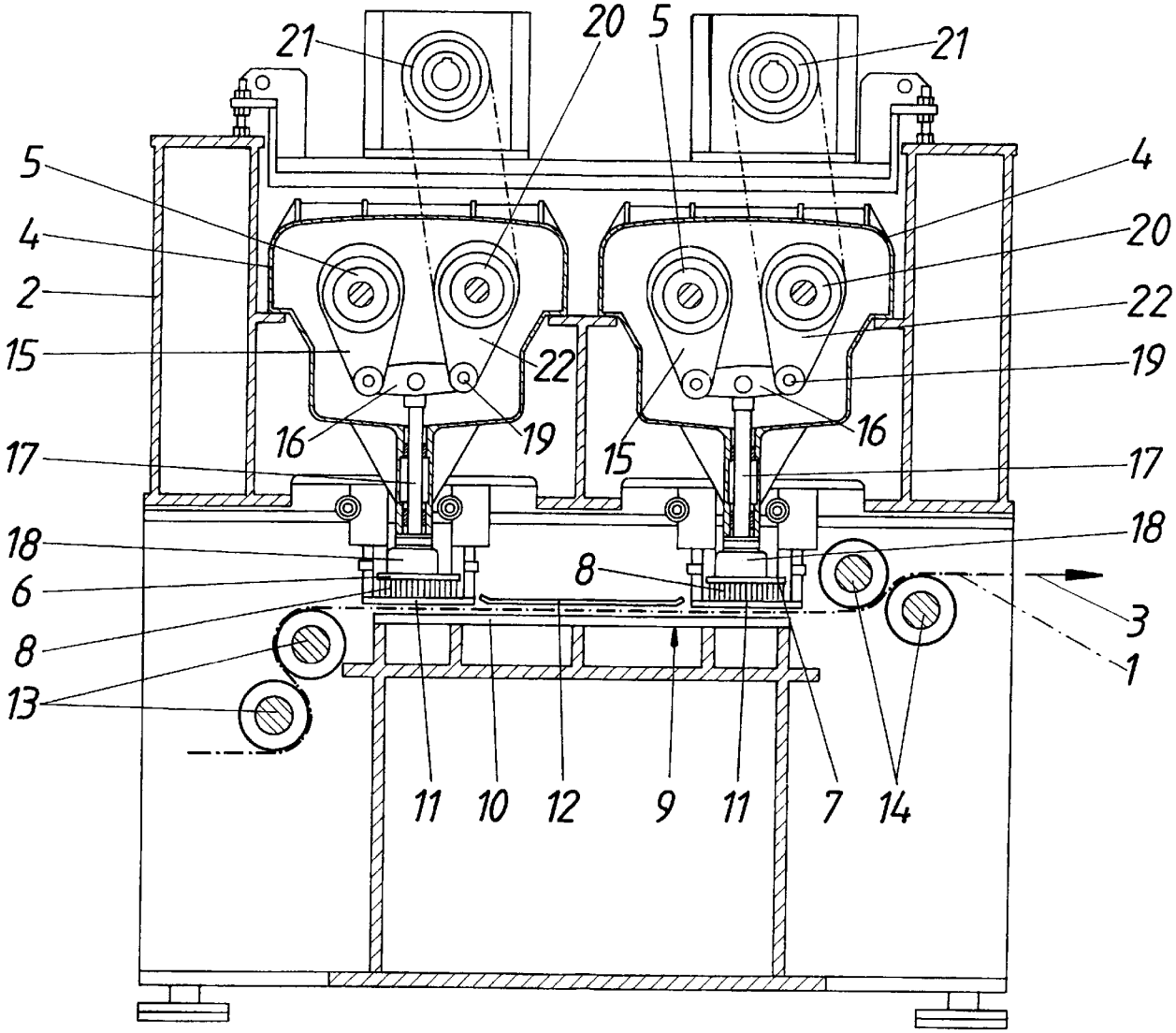
4
20
22
19
17
18
3
1
21
14
16
7
11
5
9
15
8
20
12
22
19
10
11
21
16
5
4
2
15
17
18
6
8
13

FACILITY FOR NEEDLING OF A PATTENED WIDTH OF FELT

FIELD OF THE INVENTION

The invention refers to a facility for needling of a patterned width of felt by means of a needling facility, which comprises at least one needle board and a felt guide between a felt rest and a stripper, with the felt bed either consisting of lamellas running in felt feed direction or of a circulating brush-type bed moving along with the width of felt in felt feed direction.

DESCRIPTION OF THE PRIOR ART

To produce patterned widths of felt, the needles of a needle board pushing through the width of felt form thread loops projecting over the felt surface on the exit side of the needles and developing a pattern corresponding with the respective distribution of the needles. In order to prevent that looping is adversely affected by the felt bed, it is generally usual to provide lamellas for the felt bed running in felt feed direction, between which the needles of the needle boards push through the width of felt forming loops, without adversely affecting the thread loops when the width of felt is conveyed during felt release on part of the needles or without inadmissibly increasing the resistance of the delivered felt. A felt bed for needling of loops through a width of felt can also be developed as a brush-type bed so that the loops are needled in between the bristles of the brush-type bed, which in this case must be moved along with the width of felt and consequently must describe a circulating movement. In terms of production engineering, the major drawback of these known needling facilities for patterned widths of felt is the fact that the distribution of the needles on the needle board determines a pattern for the width of felt, which can only be repeated.

To be able to produce patterns with pattern sections of different threads, it is known (AT 347 704 B) to arrange several needling facilities in tandem in felt feed direction and to equip the needle boards of the individual needling facilities only with the needles necessary for one pattern section. This measure permits to apply the fibers necessary for the relevant pattern section to the felt before each needling sequence and to remove by suction the fibers not needled into the width of felt after the needling sequence, so that an overall pattern can be composed of individual sections which must be needled separately. Needling of the individual pattern sections is carried out during standstill of the width of felt. Although, by means of such facilities consisting of several needling units patterns with sections of various fibers can be needled, the pattern proper can only be repeated.

Finally, to be able to subject a width of fleece to a pre-needling, a main needling and subsequent sewing up sequence in one operation to form pile threads, it is known (DE 22 63 949 A) to feed the fleece guided on one common felt bed to needle boards arranged in tandem and equipped with the needles provided for the relevant processing sequence. In the area of the individual needle boards the desired needling conditions are achieved independent of the needle boards arranged upstream and downstream, so that there are identical conditions for needling of pile threads on the delivery side as there are for pile thread formation in case of separate needling units. This means that any pattern of the delivered width of felt depends only on the needle distribution of the needle board provided for that purpose.

SUMMARY OF THE INVENTION

Therefore, the invention has the task to design a facility for needling of a patterned width of felt of the above mentioned kind in such a way that the diversity of the patterns to be produced by needling can be considerably increased.

The invention solves the task by the fact that the needling unit is equipped with at least two independently driven needle boards, arranged in tandem in felt feed direction at a distance to each other, with needle distributions for preferably different patterns, and that the two needle boards have one common continuous felt bed arranged between them.

By providing at least two needle boards arranged in tandem in felt feed direction at a distance to each other with needle distributions for different patterns, the patterns of the two needle boards can be applied alternately, which not only increases the diversity of patterns, but also permits patterns, which as yet could not be produced in one needling sequence. This is especially true for carpet production, as it is now possible to needle patterns in the form of an ornamental border going all around and clearly distinguished from the pattern field enclosed on all sides by the ornamental border. For this purpose it is sufficient that the feed side needle board has a needle distribution corresponding with the ornamental border, while the subsequent delivery-side needle board has a needle arrangement for the ornamental border at the two opposite outside edges, and a needle distribution to form the pattern field proper of the carpet between these edge areas. However, care must be taken that needling of the pattern by the downstream needle board does not adversely affect the already needled pattern of the upstream needle board. For this purpose the two needle boards must be controlled as a function of the feed of the width of felt to ensure an accurate joining of the patterns of the individual needle boards according to the respective register. However, this measure alone is not sufficient, as an alignment of the patterns of the consecutive needle boards over the width of the felt is necessary, too. This requirement is easily met by the fact that the felt bed between the two needle boards is a continuous one, so that the fiber loops between the lamellas of the felt bed and/or the fiber loops needled into the brush-type bed are preserved between the needle boards. Although, in most cases, the needle boards will have needle distributions for different patterns, this is by no means imperative, since different patterns can be obtained with identical needle distributions, for example, if needling is done either overlapping or with different pricking depths or different feeds.

The two needle boards can be driven via a common drive, provided that it is seen to it that the needle boards can be coupled to or uncoupled from the common drive independent of each other. However, simpler construction features are achieved, if the two needle boards are driven via separate drives.

As already specified, sufficient guiding of the pattern-forming fiber loops between the two needle boards must be provided for to ensure an accurate joining of the patterns assigned to the individual needle boards. This means that the width of felt must be kept engaged with the felt bed between the needle boards. To this end a common continuous stripper of both needle boards might be arranged. However, it is recommended to provide a holding-down device for the width of felt guided on the continuous felt bed between the strippers assigned to the two needle boards, to be able to adjust the strippers according to the prevailing conditions with respect to the needles withdrawing from the width of felt.

BRIEF DESCRIPTION OF THE DRAWINGS

The drawing depicts an example of the subject matter of the invention, showing a facility for needling of a patterned width of felt according to the invention in a schematic longitudinal section.

DESCRIPTION OF THE PREFERRED EMBODIMENTS

According to the depicted example of embodiment, the facility for needling of a patterned width of felt 1 is equipped with two housings 4 for the lifting drive 5 of one needle board 6 and/or 7 each, held in a frame 2 and arranged in tandem in fleece feed direction 3, the needles 8 of which needle boards pricking into the width of felt 1 from above. The width of felt 1 is guided on a continuous felt bed 9 between the needle boards 6 and 7, which felt bed 9 consists of lamellas 10 running parallel to felt feed direction, between which the needles 8 of the needle boards 6 and 7 push through the width of felt 1 forming loops. In the area of the needle boards 6 and 7 conventional strippers 11, adjustable in height, and between these strippers 11 a holding-down device 12 for the width of felt 3 is provided, which may be formed by a simple sliding plate, in contrast to the stripper 11, which is passed through by the needles 8. The only important thing is that the fiber loops pulled out of the width of felt 1 during pushing through the needles 8, and projecting between the lamellas 10 of the felt bed 9 are subjected to a continuous restricted guidance between the lamellas 10 from the feeding-side needle board 6 to the delivery-side needle board 7, permitting an accurate adjustment of the patterns determined by the respective needle distribution on the two needle boards 6 and 7. Feeding of the width of felt 1 is effected between a pair of draw-in rollers 13 and a pair of delivery rollers 14, which may be driven by electric motors not depicted in the drawing.

The lifting drives 5 for the needle boards 6 and 7 are designed identically and conventionally consist of a drive eccentric acting at oscillating cranks 16 via connecting rods 15, at which oscillating cranks 16 the pushing rods 17 for the needle bars 18 carrying the boards 6 and 7 are articulated. For adjustment of the lifting position of the needle boards 6 and 7, the slewing bearings 19 of the oscillating cranks 16 are connected with an adjustment device 20,which is equipped with an adjustment eccentric turnable via a motor actuator 21 with connecting rods 22 carrying the slewing bearings 19 of the oscillating cranks 16. Thus the lifting position of the needle boards 6 and 7 is, separate for each needle board 6 and/or 7, infinitely adjustable against a width of felt 1 resting on the felt bed 9, between a return stroke, where there is no pricking of the needles 8 of the respective needle board 6 into the width of felt 1, and an operating stroke for the greatest pricking depth. This adjustment can be effected even during needling. The lifting drives 5 for the two needle boards 6 and 7 are preferably coupled with separate driving motors, to ensure in a simple way the independent control of the drives of the two needle boards as a function of the pattern sequence and pattern stretch desired in each case.

As the two needle boards 6 and 7 have different needle distributions depending on the pattern to be produced, the width of felt 1 can alternatively be provided with the patterns of the two needle boards 6 and 7. For example, it is possible to needle the width of felt 1 with the pattern of the needle distribution of the feeding-side needle board 6 before the pattern to be produced by the needle board 7 is needled, which shall immediately and without overlapping adjoin the pattern of the needle board 6. For this purpose the needle board 7 may be started only after the rear closing, in feed direction 3, of the pattern formed by the upstream needle board 6 has arrived in the feeding area of the needling zone of the needle board 7 due to the feed of the width of felt 1. If a pattern according to the needle board 6 shall be adjoined to the pattern of the needle board 7, the drive for the needle board 6 must be switched on before switching off the drive for the needle board 7 to allow for the distance between the two needle boards 6 and 7. The consecutive needle board 7 is stopped only after the front closing of the felt pattern produced by the needle board 6 reaches the needling zone of the needle board 7. Thus it is shown that, by means of such a needling facility, the possible diversity of patterns can be considerably extended. For an extension of the diversity of patterns it is also possible to apply further needle boards with different needle distributions.

Of course, the invention is not confined to the depicted example of embodiment, since the only important aspect is to arrange in tandem in a needling facility at least two needle boards suitable for needling patterns of various kinds, in such a way that they can be controlled independent of each other. Moreover, between the needle boards arranged in tandem the felt must be guided in such a way that an accurate adjustment of patterns against each other is permitted, as this is the case with a continuous felt bed common for the applied needle boards, whether this felt bed is designed as a lamella grating or as a circulating brush-type bed. In this context it shall additionally be pointed out that feeding of the felt need not be only in the specified feed direction 3 according to the depicted example of embodiment, but is also possible in a reversing mode, which may be favorable with respect to lining up of patterns.

What is claimed is:

1. An apparatus for needling a patterned web of felt with a needling equipment comprising (a) at least two independently driven needle boards with needle distributions for different patterns, the needle boards being spaced from each other in a feed direction of the web of felt, and (b) a continuous felt bed common to the needle boards and a stripper associated with each needle board wherebetween the web of felt is guided in the feed direction, the felt bed consisting of either lamellas extending in the feed direction or a brush-type bed moving with the web of felt in the feed direction.

2. The apparatus of claim 1, comprising a separate drive for each independently driven needle board.

3. The apparatus of claim 1, further comprising a holding-down device for the web of felt guided on the felt bed, the holding-down device being arranged between the strippers.

* * * * *